US011413628B2

(12) United States Patent
Marra et al.

(10) Patent No.: US 11,413,628 B2
(45) Date of Patent: Aug. 16, 2022

(54) ELECTROSTATIC PARTICLE FILTERING

(71) Applicant: KONINKLIJKE PHILIPS N.V., Eindhoven (NL)

(72) Inventors: Johannes Marra, Eindhoven (NL); Achim Gerhard Rolf Koerber, Eindhoven (NL); Cornelis Reinder Ronda, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 324 days.

(21) Appl. No.: 16/465,588

(22) PCT Filed: Dec. 1, 2017

(86) PCT No.: PCT/EP2017/081275

§ 371 (c)(1),
(2) Date: May 31, 2019

(87) PCT Pub. No.: WO2018/100197

PCT Pub. Date: Jun. 7, 2018

(65) Prior Publication Data

US 2019/0381516 A1 Dec. 19, 2019

(30) Foreign Application Priority Data

Dec. 1, 2016 (EP) ..... 16201686

(51) Int. Cl.
*B03C 3/68* (2006.01)
*B03C 3/12* (2006.01)
(Continued)

(52) U.S. Cl.
CPC ..... *B03C 3/68* (2013.01); *B03C 3/08* (2013.01); *B03C 3/12* (2013.01); *B03C 3/368* (2013.01);
(Continued)

(58) Field of Classification Search
CPC combination set(s) only.
See application file for complete search history.

(56) References Cited

U.S. PATENT DOCUMENTS 4,861,356 A * 8/1989 Penney ..... B03C 3/12 96/77
7,857,892 B2 12/2010 Marra
(Continued)

FOREIGN PATENT DOCUMENTS

CN 202048647 U 11/2011
CN 202538009 U 11/2012
(Continued)

OTHER PUBLICATIONS

C.N. Davies, "The Proceediings of the Physical Society", Definitive Equations for the Fluid Resistance of Spheres, vol. 57, Part 4, No. 322, Jul. 1, 1945.
(Continued)

*Primary Examiner* — Christopher P Jones
*Assistant Examiner* — Sonji Turner
(74) *Attorney, Agent, or Firm* — Schott, P.C.

(57) ABSTRACT

An electrostatic air cleaning device comprises a particle charging section, a particle precipitation section, a current sensor for measuring an electric current flowing through electrode plates of the precipitation section and a relative humidity sensor. The voltage applied to the electrode plates and the air flow through the device are controlled in dependence on the measured current flowing through the electrode plates. In this way, control is provided to prevent excessive electric leakage currents inside the precipitation section, that may lead to a hazard, and to optimize the energy efficiency of the cleaning device in relation to its cleaning performance. The relative humidity information also enables diagnosis of the cause of the high leakage current and the status of the precipitation section concerning the amount of precipitated particles therein.

13 Claims, 2 Drawing Sheets

(51) Int. Cl.

| | |
|---|---|
| ***B03C 3/36*** | (2006.01) |
| ***B03C 3/47*** | (2006.01) |
| ***B03C 3/08*** | (2006.01) |

(52) U.S. Cl.

CPC ..... *B03C 3/47* (2013.01); *B03C 2201/14* (2013.01); *B03C 2201/24* (2013.01); *B03C 2201/32* (2013.01)

(56) References Cited

U.S. PATENT DOCUMENTS

| | | | | |
|---|---|---|---|---|
| 2008/0041138 | A1 | 2/2008 | Marra | |
| 2013/0091298 | A1 | 3/2013 | Tanimura | |
| 2014/0345463 | A1* | 11/2014 | Urata ..... | F24F 8/192 96/21 |

FOREIGN PATENT DOCUMENTS

| | | | | |
|---|---|---|---|---|
| CN | 105750087 | A | | 7/2016 |
| JP | H08-215608 | A | | 8/1996 |
| JP | H1190270 | | | 4/1999 |
| JP | 2000-051736 | A | | 2/2000 |
| JP | 2005288230 | A | | 10/2005 |
| JP | 2007225246 | A | | 9/2007 |
| JP | 2008068207 | A | * | 3/2008 |
| JP | 2008068207 | A | | 3/2008 |
| JP | 2010142773 | A | | 7/2010 |
| JP | 4657168 | B2 | | 3/2011 |
| JP | 2013230455 | A | | 11/2013 |
| WO | 2016055850 | A1 | | 4/2016 |

OTHER PUBLICATIONS

Adachi et.al. in Journal of Aerosol Science 16 (1985) pp. 109-123.

* cited by examiner

ELECTROSTATIC PARTICLE FILTERING

This application is the U.S. National Phase application under 35 U.S.C. § 371 of International Application No. PCT/EP2017/081275, filed on Dec. 1, 2017 and International Application No. 16201686.9, filed Dec. 1, 2016. These applications are hereby incorporated by reference herein.

FIELD OF THE INVENTION

The invention relates to methods and apparatus for electrostatic particle filtering and air cleaning using electrostatic particle filtering.

BACKGROUND OF THE INVENTION

Electrostatic air (or other gas) cleaning devices are widely known. Such devices for example employ ion acceleration generated by a corona discharge method in conjunction with the charging and collection of gas/air-borne particulates, such as dust.

Corona discharge devices apply a high voltage potential between discharging (corona) electrodes and collecting (or accelerating) electrodes to create a high intensity electric field and generate a corona discharge in a vicinity of the discharging electrodes. This performs particle charging through the adsorption of corona-generated ions on the airborne particles. Collisions between the ions generated by the corona and surrounding gas molecules also transfer the momentum of the ions to the gas thereby inducing a corresponding movement of the air to achieve an overall movement of air in a desired air flow direction. A fan can also be used to provide further control of the air flow through the device.

Following particle charging, the charged particles are precipitated from air onto a set of collecting electrodes. Together with a set of precipitation electrodes, the collecting electrodes form parallel-plate structures wherein each collection electrode plate is parallel positioned in between two precipitation electrode plates thereby maintaining a controlled spacing between neighboring plates that serves as air conduit. This device design is popular because particle capture from air can be realized at a lower energy consumption than when mechanical fibrous filters are used. This is due to the incurred lower air pressure drop when air is passed through the straight conduits between the parallel plates in the electrostatic particle filter. Moreover, the parallel-plate structures can be easily cleaned in a dishwasher or washed by hand and thus regenerated when they contain large amounts of captured particles. Fibrous filters cannot easily be regenerated and must be discarded as waste.

The particle charging section is positioned upstream from the parallel-plate structure. Particle charging is therein accomplished by high-voltage air ionization, usually by involving thin corona wires. Discharged ions from the corona wires adsorb on airborne particles during their passage through the charging section, thereby charging the particles. The charged particles can subsequently be precipitated by means of an electrostatic field that is set up between neighboring plates in the downstream parallel-plate section.

A problem with the parallel-plate filter structure is that a significant leakage current $I_{leak}$ can arise between neighboring plates in the precipitation section. The leakage current increases at increasing amounts of captured particles in the precipitation section and at increasing relative humidity (RH) levels. Part of the leakage current is a DC leakage current which flows across the surfaces of spacers between the precipitation plates when these surfaces become covered with particle deposits. These deposits act as conducting pathways between neighboring plates between which an electric field exists. Deposited cigarette smoke particles are known to form such conducting pathways, increasingly so with increasing RH because of the then increasing amount of absorbed moisture in the particle deposits.

Another part of the leakage current is a spiky current which comes from back-corona discharges across the gap between neighboring plates. These also tend to increase at increasing RH and increasing amounts of particle deposits on the collector plates. At high RH levels and/or filter loading levels with particles, the leakage current can exceed the capacity of the high voltage supply. Usually, the leakage current is ensured not to exceed a set maximum value by means of a current-limiting circuit design. However this implies that the electric field between neighboring plates is then to be adjusted to a lower level. At a constant flow rate, this reduces the overall particle filtration efficiency $\eta(d_p)$ and thus the clean air delivery rate (CADR), thereby also reducing the power utilization factor.

Accordingly, a need exists for an electrostatic particle filter that enables power-efficient operation even when leakage currents in the particle precipitation stage increase.

US 2014/0345463 discloses an electrostatic precipitation apparatus in which a current sensor is used to detect an anomalous discharge current and this may be used to shut down the device or operate at reduced voltage. US 2008/0041138 discloses an air pollution sensor which may include an electrostatic filter, which includes end of filter lifetime detection.

SUMMARY OF THE INVENTION

The invention is defined by the claims.

According to an aspect of the invention, there is provided an electrostatic air cleaning device comprising:

a particle charging section;

a particle precipitation section, comprising parallel electrode plates;

a source of electric potential for applying a voltage between adjacent electrode plates in the precipitation section;

a current sensor for measuring an electric current flowing through the electrode plates;

a relative humidity sensor;

a flow controller; and a device controller, wherein the device controller is adapted to control the source of electric potential and the flow controller in dependence on the measured current flowing through the electrode plates, wherein the device controller is adapted to implement:

a first, normal, operation mode when the measured current flowing through the electrode plates is below a current threshold; and a second mode when the measured current flowing through the electrode plates is above the current threshold and the source of electric potential and the flow controller are controlled to reduce the current, and the the measured current is determined to be caused by a high relative humidity; and a third mode when the measured current flowing through the electrode plates is above the current threshold and the source of electric potential and the flow controller are controlled to reduce the current, and the the measured current is determined to be caused by the level of particle deposition in the particle precipitation section, wherein in the third mode the controller is adapted to provide output information (38) as an output signal indicating that cleaning or replacement of the precipitation section is required.

This device controls the electrostatic air cleaning process taking account of the current flowing through the precipitation electrodes, and it also takes account of the prevailing relative humidity of the air passing through the air cleaning device. The current is a leakage current, and it is indicative of particle build up on the precipitation plate electrodes and on the surfaces of the spacers that maintain a fixed distance between adjacent electrode plates. The voltage applied between adjacent electrode plates is controlled so that the leakage current is limited, and this prevents damage to the power source (i.e. the source of electric potential) and hazardous situations such as a fire. Resulting short circuits may also be audible and they may also create a smell.

By additionally controlling the air flow, the power consumption per unit volume of cleaned air can also be prevented from dropping too low. The air flow is controlled taking account of the voltage which is being applied to the precipitation electrode plates. By monitoring the relative humidity in the air treated by the device, it can be determined if a high leakage current is primarily caused by a high relative humidity or by particle build up on the precipitation electrodes. In this way, the cause of the high leakage current can also be diagnosed. In the case of high particle build up, an output is provided to indicate that the precipitation section needs cleaning or replacement.

In more detail, the device controller may be adapted to implement the first control mode when the measured current flowing through the electrode plates is below a current threshold, in which a maximum electric potential is applied between the adjacent electrode plates and the flow controller implements a flow rate as selected by the user of the device.

This is the normal operating mode, when the leakage current is below a threshold, meaning the device is working normally.

The device controller may be adapted to implement the second control mode when the sensed relative humidity exceeds a humidity threshold and the measured current flowing through the electrode plates exceeds a current threshold, in which the electric potential applied between the adjacent electrode plates is reduced until the measured current flowing through the electrode plates reduces to the current threshold and the flow controller implements a flow rate reduction until a filtration efficiency reaches an efficiency threshold.

This is a mode of operation when high leakage current occurs, at least in part because of a high relative humidity. The voltage applied between neighboring electrode plates is reduced to control and limit the leakage current, and the flow rate is also controlled to ensure the device is operating at a satisfactory air cleaning efficiency and thus power utilization efficiency.

The device controller may be adapted to implement the third control mode when the sensed relative humidity is below a humidity threshold and the measured current flowing through the electrode exceeds a current threshold, in which the electric potential applied between the adjacent electrode plates is reduced until the measured current flowing through the electrode plates reduces to the current threshold and the flow controller implements a flow rate reduction until a filtration efficiency reaches an efficiency threshold.

This is a mode of operation when a high leakage current occurs, but not because of a high relative humidity. The voltage applied between adjacent electrode plates is again reduced to control the leakage current, and the flow rate is also controlled to ensure the device is operating at a satisfactory filtration efficiency. However, this mode is also indicative of the presence of a significant amount of precipitated particles in the filter.

The device controller may thus be adapted in the third mode to provide an output signal indicating that cleaning or replacement of the precipitation section is required. Examples in accordance with another aspect of the invention provide an electrostatic air cleaning method comprising:

charging airborne particles in an air flow using a charging section;

filtering the air flow using a particle precipitation section which comprises parallel electrode plates having a voltage between adjacent electrode plates;

measuring an electric current flowing through the electrode plates;

sensing a relative humidity; and controlling the voltage between adjacent electrode plates, wherein the device controller implements:

a first, normal, operation mode when the measured current flowing through the electrode plates is below a current threshold; and a second mode when the measured current flowing through the electrode plates is above the current threshold and the source of electric potential and the flow controller are controlled to reduce the current, and the the measured current is determined to be caused by a high relative humidity; and a third mode when the measured current flowing through the electrode plates is above the current threshold and the source of electric potential and the flow controller are controlled to reduce the current, and the the measured current is determined to be caused by the level of particle deposition in the particle precipitation section, wherein in the third mode the controller provides output information (38) as an output signal indicating that cleaning or replacement of the precipitation section is required.

This is the method implemented by the device defined above.

A first control mode may be implemented when the measured current flowing through the electrode plates is below a current threshold, in which a maximum electric potential is applied between the adjacent electrode plates and the flow controller implements a flow rate as selected by the user of the device.

A second control mode may be implemented when the sensed relative humidity exceeds a humidity threshold and the measured current flowing through the electrode plates exceeds a current threshold, in which the electric potential applied between the adjacent electrode plates is reduced until the measured current flowing through the electrode reduces to the current threshold and the flow controller implements a flow rate reduction until a filtration efficiency reaches an efficiency threshold.

A third control mode may be implemented when the sensed relative humidity is below a humidity threshold and the measured current flowing through the electrode exceeds a current threshold, in which the electric potential applied between the adjacent electrode plates is reduced until the measured current flowing through the electrode reduces to the current threshold and the flow controller implements a flow rate reduction until a filtration efficiency reaches an efficiency threshold.

The efficiency threshold used in the second and third modes for example comprises a fractional filtration efficiency for a particular particle size. The particular particle size is for example 200 nm particle diameter and the fractional filtration efficiency threshold is for example 0.9.

The flow controller may be a fan. However, the flow may instead be an ionic wind. In this case, the flow controller may be adapted to control the corona current in the charging section in order to implement flow changes.

The control method may be implemented at least in part in software.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides an electrostatic air cleaning device comprising a particle charging section, a particle precipitation section, an electric current sensor for measuring a current flowing through electrode plates of the precipitation section and a relative humidity sensor. The voltage applied to the electrode plates and the flow through the device are controlled in dependence on the measured current flowing through the electrode plates. In this way, control is provided to prevent excessive leakage currents. The relative humidity information also enables diagnosis of the cause of the high leakage current and the status of the precipitation section concerning the amount of precipitated particles therein.

Figure 1:
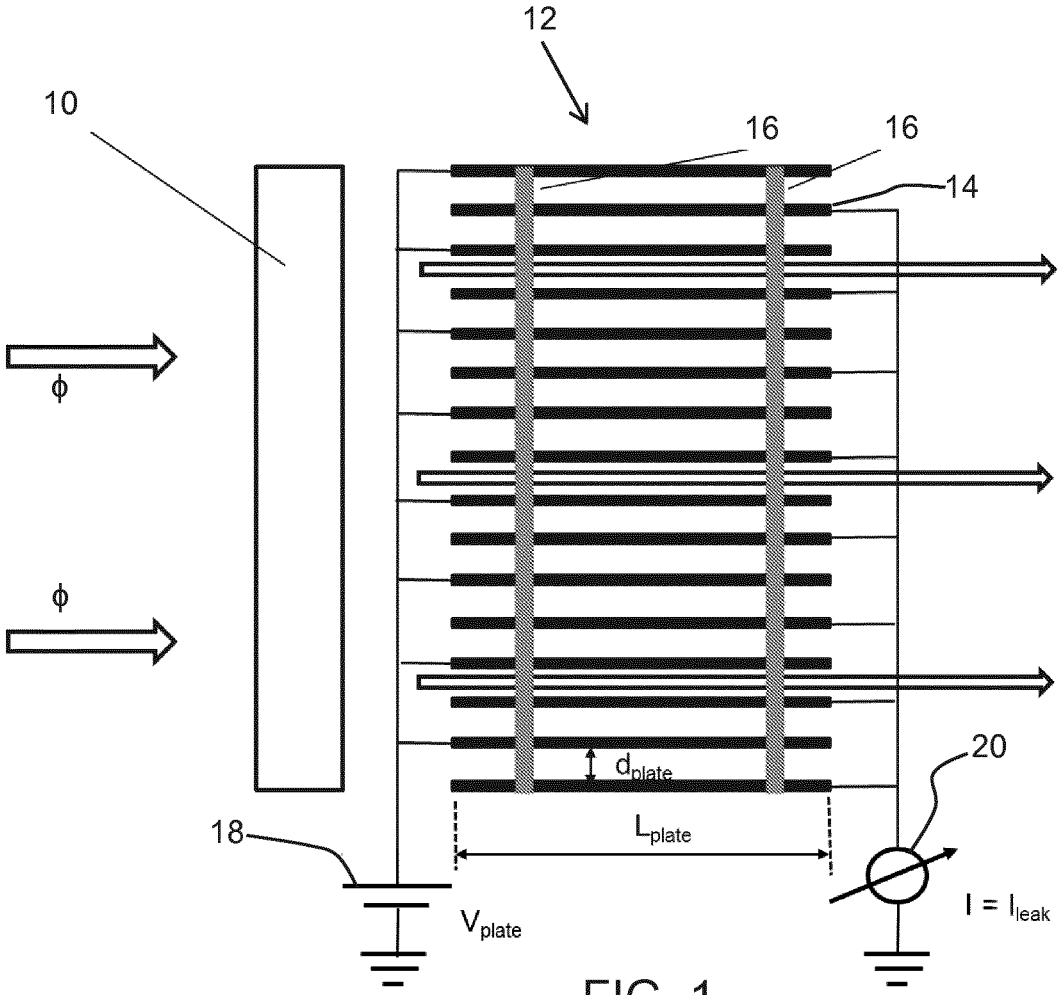
FIG. 1 shows an electrostatic particle precipitation filter.

FIG. 1 shows the basic structure of an electrostatic particle filter.

There is a particle charging section 10 which receives a polluted air flow at an airflow rate $\phi$. The particle precipitation section 12 comprises an array of parallel plates 14 held in position by electrically insulating spacers 16 of a spacer array. The plates comprise alternate precipitation electrodes and collector electrodes.

The plates 14 have a length $L_{plate}$ and a plate separation $d_{plate}$ which is maintained by the spacer array. A cleaned airflow is output from the precipitation section 12. The power supply 18 for the precipitation section comprises a voltage source which applies a voltage $V_{plate}$ between each adjacent pair of plates 14. Thus, one set of alternate plates are grounded and the other set are at the potential $V_{plate}$. One set is the precipitation electrodes and the other set is the collector electrodes.

The charged particles are in this way precipitated onto the collector electrode plates by an electrostatic field:

$$E_{plate}=V_{plate}/d_{plate}$$

This field is set up between adjacent plates 14 in the array in the downstream parallel-plate section. As such, the parallel-plate section serves as the particle precipitation section.

Typically encountered design values for the particle precipitation section in domestic stand-alone air cleaners and the process parameters therein are:

3 mm$\leq d_{plate} \leq$10 mm, 3 kV$\leq V_{plate} \leq$10 kV, 0.5 kV/mm$\leq E_{plate} \leq$1.0 kV/mm, 0.5 m/s$\leq v_{air} \leq$1.5 m/s ($v_{air}$ is the average air speed between adjacent electrode plates), 30 mm$\leq L_{plate} \leq$150 mm ($L_{plate}$ is the length of the electrode plates in the air flow direction), 150 mm$\leq H_{plate} \leq$400 mm ($H_{plate}$ is the height of the electrode plates in the direction perpendicular to the air flow direction), The number of electrode plates in the precipitation section can exceed 100, dependent on the above-mentioned design values and the volumetric airflow rate $\phi$ that needs to be cleaned by the cleaning device.

The fractional filtration efficiency $\eta(d_p)$ towards particles of diameter $d_p$ that are charged with $n(d_p)$ elementary charges is, under conditions of laminar flow between the electrode plates, given by:

$$\eta(d_p) = \frac{n(d_p)eC_c(d_p)L_{plate}E_{plate}}{3\pi v_{av}\mu_{air}d_p d_{plate}} \quad \text{if} \quad \frac{n(d_p)eC_c(d_p)L_{plate}E_{plate}}{3\pi v_{av}\mu_{air}d_p d_{plate}} \leq 1$$

$$\eta(d_p) = 1 \quad \text{if} \quad \frac{n(d_p)eC_c(d_p)L_{plate}E_{plate}}{3\pi v_{av}\mu_{air}d_p d_{plate}} > 1$$

$v_{av}$ denotes the average air speed between the plates and is directly proportional to the flow rate $\phi$ at fixed dimensions of the precipitation section;

$\mu_{air}$ is the air viscosity ($\mu_{air}=1.8\times10^{-5}$ Pa·s at room temperature);

"e" is the elementary charge ($e=1.6\times10^{-19}$ C);

$C_c(d_p)$ is the Cunningham slip correction factor. For its dependence on the particle diameter $d_p$ reference is made to Chapter 3 in the book of W. C. Hinds "Aerosol Technology: Properties, Behavior and Measurement of Airborne Particles" $2^{nd}$ Edition (John Wiley & Sons).

Typical average values for the number of elementary charges $n(d_p)$ on a particle of diameter $d_p$ that result from ion adsorption in a corona discharge are (somewhat dependent on the intensity of the corona discharge current):

$n\approx$2-3 for $d_p$=80 nm, $n\approx$5-6 for $d_p$=200 nm.

Reference is made to Adachi et. al. in Journal of Aerosol Science 16 (1985) pp. 109-123, wherein particle charging is predicted on the basis of the Fuchs particle charging theory, and experimentally verified.

From the field of filtration technology (see for example Chapter 9 in the book "Aerosol Technology: Properties, Behavior and Measurement of Airborne Particles" referenced above), it is well-known that $\eta(d_p)$ reaches a minimum value $\eta(d_p)=\eta_{min}$ for particle sizes close to 200 nm diameter. The electrostatic filter is generally designed and operated such that, for $d_p$~200 nm, $\eta_{min}\geq\eta_{set}$ with $\eta_{set}\geq$0.9. By way of example, the latter efficiency is approximately achieved at $L_{plate}$=100 mm when $v_{air}$=1 m/s, $d_{plate}$=4 mm and $E_{plate}=V_{plate}/d_{plate}$=1 kV/mm.

As explained above, a problem with the parallel-plate filter structure is that a significant leakage current $I_{leak}$ can arise between neighboring plates in the precipitation section. At high relative humidity levels and/or high filter loading levels with particles, $I_{leak}$ can exceed the capacity of the supply 18. Usually, $I_{leak}$ is ensured not to exceed a set maximum value $I_{leak,\ max}$, however this implies that the electric field $E_{plate}$ between neighboring plates is then to be adjusted to a lower level, which reduces the overall particle filtration efficiency $\eta(d_p)$.

The invention is based on controlling the filter operation and/or air cleaner operation in response to feedback from a controller that receives data on the ambient relative humidity and the leakage current level. In addition, it may also issue a warning to the user to clean or replace the filter.

To the extent described above, the structure of FIG. 1 is known. For reasons of minimizing the ozone production in the particle charging section, a positive corona voltage is preferably used for particle charging, resulting in a positive particle charge. These positively-charged particles can be precipitated from air onto collector electrode plates that are connected to a negative voltage $V_{plate}$ when connecting adjacent precipitation electrode plates to the reference (zero or ground) potential. Alternatively, the precipitation electrode plates can be connected to a positive voltage $V_{plate}$ when the collector electrode plates are connected to zero or ground potential.

To implement the approach of the invention, a leakage current meter 20 is additionally provided, which measures a leakage current through the electrode plates to ground. The current meter 20 is thereby attached to the set of electrode plates that is connected to zero or ground potential. By connecting the complete set of all zero-potential electrode plates via the current meter to zero or ground potential, the combined leakage current $I_{leak}$ to ground is measured. The current meter may be implemented simply as a current sense resistor, wherein the voltage across the resistor is measured and is then used as an input to a controller. The current meter 20 is preferably enabled to measure a DC current baseline value as well as possible current spikes that may be superimposed thereon. The measured average electric leakage current $I_{leak}$ is then obtained from the total integrated charge Q passing through the current meter within a time period T as $I_{leak}=Q/T$. Preferably, $T\geq 10$ s and $I_{leak}$ may be determined in the course of time as a moving average from the measured charge over time.

Figure 2:
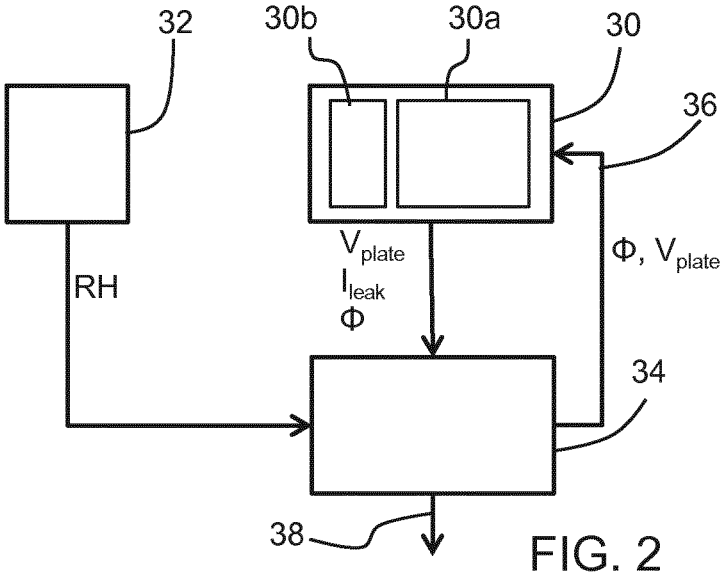
FIG. 2 shows an air cleaning device using the filter of FIG. 1.

FIG. 2 shows the overall system, which may be considered to be an air cleaning device. It comprises an air cleaning section 30 which comprises the electrostatic air filter 30*a* of FIG. 1 including the leakage current meter, and a fan 30*b*.

The fan 30*b* functions as a flow controller. The device may instead operate based on an ionic wind airflow. In such a case, the charging section 10 also functions as the flow controller.

In addition, there is a relative humidity meter 32 and a controller 34. The controller receives the relative humidity level RH from the sensor 32 and also the plate voltage $V_{plate}$, the leakage current $I_{leak}$ and the airflow rate $\phi$ from the air cleaning section 30.

A feedback path 36 enables the settings of $V_{plate}$ and $\phi$ to be adjusted, as well as enabling suitable display status messages to be provided. The flow rate is controlled by controlling the fan speed or by controlling the corona current in the charging section in case the air flow is induced by the ionic wind. Because the airflow induced by the ionic wind can only induce a very small pressure drop ($\leq$1 Pa) across the air cleaning device, use of a fan is preferred when high airflow rates (>150 $m^3$/hour) are to be treated with relatively small-sized air cleaning devices.

The controller implements a control approach in which various different control settings are applied.

If, at any RH, $I_{leak}<I_{leak}$, max then $V_{plate}=V_{plate,max}$ and $\phi\leq\phi_{max}$ (also dependent on manual settings)

This control setting is used if the leakage current is below a maximum set value $I_{leak,max}$, the particle filter is determined to be performing optimally and makes optimum use of the input power level. Preferably, $V_{plate,max}$ is chosen such as to yield a maximum electric field strength in the range 0.5 kV/mm$\leq E_{plate,max}=V_{plate,max}/d_{plate}\leq$1.0 kV/mm between adjacent electrode plates.

If, at $RH>RH_{set}$, $I_{leak}\geq I_{leak,max}$ then $V_{plate}$ is reduced until $I_{leak}=I_{leak,max}$ and $\phi$ is simultaneously reduced until $\eta(d_p)=\eta_{set}$ (for $d_p$~200 nm).

This control setting is used when there is a high relative humidity and a higher leakage current at $V_{plate}=V_{plate,max}$ than a maximum leakage current level $I_{leak,max}$. The operational settings of the filter (plate voltage $V_{plate}$) and the air cleaner airflow ($\phi$) are now adjusted to deal with the high ambient relative humidity such as to optimize the power utilization factor. Preferably, the set level $RH_{set}\geq$70%. At RH$\geq$70%, and particularly when RH$\geq$90%, moisture absorption on the (particle-contaminated) surfaces of the spacer structures separating the plate electrodes may occur at such a degree that it creates a conductive path between the plates such as to yield a leakage current exceeding $I_{leak,max}$ at $V_{plate,max}$, even when only a modest amount of particles has been captured on the collector plates. For example, freshly-deposited cigarette smoke particles are particularly notorious for their high degree of moisture absorption at RH$\geq$70% and they can induce a significant leakage current when polluted moist air is to be treated by the air cleaning device. The plate voltage is reduced until the leakage current drops to the maximum level. Furthermore, the airflow is reduced until a desired efficiency is reached.

If, at $RH\leq RH_{set}$, $I_{leak}\geq I_{leak,max}$ then $V_{plate}$ is reduced until $I_{leak}=I_{leak,max}$ and $\phi$ is simultaneously reduced until $\eta(d_p)=\eta_{set}$ (for $d_p$~200 nm).

This control setting is used when there is not a high relative humidity but the leakage current is higher than the maximum level. The operational settings of the filter (plate voltage $V_{plate}$) and the air cleaner (airflow $\phi$) are again adjusted to deal with the ambient relative humidity such as to optimize the power utilization factor. In this case, the high leakage current is primarily caused by the high degree of filter loading with particles rather than the humidity level, so a warning message "filter replacement recommended" or "filter cleaning recommended" is displayed. This is shown as an output 38 from the controller 34 in FIG. 2. The filter is loaded with a large amount of deposited particles, which induces a high value for the leakage current even at relative humidity values below the set threshold $RH_{set}$.

At decreased values for $V_{plate}$ at which $I_{leak}\leq I_{leak,max}$, the clean air delivery rate (CADR) becomes reduced and a high power utilization factor can only be maintained by also lowering $\phi$. At increasing filter loadings with particles, the required decreases in $V_{plate}$ and $\phi$ become more severe and will ultimately lead to an unacceptable filter performance at any relative humidity level if filter replacement/cleaning servicing is not carried out.

Figure 3:
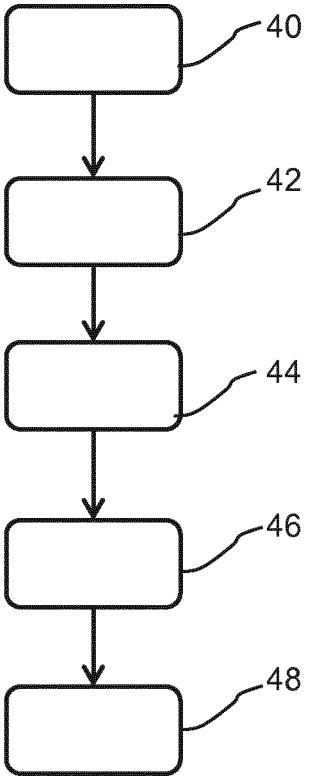
FIG. 3 shows an air cleaning method.

FIG. 3 shows an electrostatic air cleaning method.

In step 40, airborne particles in an air flow are charged using a charging section.

In step 42, the air flow is filtered using a particle precipitation section which comprises parallel electrode plates having a voltage between adjacent electrode plates.

In step 44, an electric current flowing through the electrode plates is measured.

In step 46, a relative humidity is sensed, in the vicinity of the air cleaner, for example at the air inlet.

In step 48, the voltage between adjacent electrode plates is controlled and the air flow is controlled, in dependence on the measured current flowing through the electrode plates and the sensed relative humidity.

The control of step 48 implements one of the operating modes as discussed above.

As discussed above, embodiments make use of a controller. The controller can be implemented in numerous ways, with software and/or hardware, to perform the various functions required. A processor is one example of a controller which employs one or more microprocessors that may be programmed using software (e.g., microcode) to perform the required functions. A controller may however be implemented with or without employing a processor, and also may be implemented as a combination of dedicated hardware to perform some functions and a processor (e.g., one or more programmed microprocessors and associated circuitry) to perform other functions.

Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media such as volatile and non-volatile computer memory such as RAM, PROM, EPROM, and EEPROM. The storage media may be encoded with one or more programs that, when executed on one or more processors and/or controllers, perform at the required functions. Various storage media may be fixed within a processor or controller or may be transportable, such that the one or more programs stored thereon can be loaded into a processor or controller.

It is described above how the device and method prevents the device entering an unacceptable operating regime. However, the invention also enables prediction of the remaining useful life time of the precipitation filter, by measuring the leakage current $I_{leak}$ and by means of particle concentration sensing. The particle concentration sensing may be performed using a particle sensor in the air cleaner and by particle sensors in the local environment. This provides information of interest for device servicing. This information may be provided as the "output information" and it may also take account of the relative humidity level.

Applications for an electrostatic air cleaning device for extraction of unwanted particulates (such as dust or pollutants) from air are numerous and widespread. The above described embodiments may be readily incorporated within larger air cleaning units or devices. The electrostatic air cleaning device may be placed, for example, in a series combination with one or more additional air cleaning devices or filters, such as gas filters. In this case, electrostatic air cleaning device is preferably placed upstream from the gas filter(s) in order to protect the latter from particle deposits upon active filtering surfaces. Alternatively, one or more variant embodiments of the invention may be placed in series combination with themselves, for example, embodiments having suitable arrangement for the extraction of particulate matter of different sizes.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. An electrostatic air cleaning device, comprising:

a particle charging section;

a particle precipitation section, comprising parallel electrode plates;

a source of electric potential for applying a voltage between adjacent electrode plates in the particle precipitation section;

a current sensor for measuring an electric current flowing through the electrode plates;

a relative humidity sensor for sensing relative humidity of air;

a flow controller; and a device controller, wherein the device controller is adapted to control the source of electric potential and the flow controller in dependence on the measured electric current flowing through the electrode plates, and wherein the device controller is adapted to implement:

a first, normal, operation mode when the measured electric current flowing through the electrode plates is below a current threshold;

a second operation mode when the measured electric current flowing through the electrode plates is above the current threshold and the source of electric potential is controlled to reduce the electric current, wherein the flow controller is controlled to achieve a desired filtration efficiency, and wherein the measured electric current being above the current threshold is caused by a high relative humidity; and a third operation mode when the measured electric current flowing through the electrode plates is above the current threshold and the source of electric potential is controlled to reduce the electric current, wherein the flow controller is controlled to achieve the desired filtration efficiency, wherein the measured electric current being above the current threshold is caused by a level of particle deposition in the particle precipitation section, and wherein, in the third operation mode, the device controller is adapted to provide output information as an output signal indicating that cleaning or replacement of the particle precipitation section is required.

2. The electrostatic air cleaning device as claimed in claim 1, wherein the device controller is adapted to implement the first operation mode by applying a maximum electric potential between the adjacent electrode plates, and wherein the flow controller is adapted to implement a flow rate as selected by a user of the electrostatic air cleaning device.

3. The electrostatic air cleaning device as claimed in claim 1, wherein the device controller is adapted to implement the second operation mode when the sensed relative humidity exceeds a humidity threshold and to reduce the electric potential applied between the adjacent electrode plates until the measured electric current flowing through the electrode plates reduces to the current threshold, and wherein the flow controller is adapted to implement a flow rate reduction until the desired filtration efficiency reaches an efficiency threshold.

4. The electrostatic air cleaning device as claimed in claim 1, wherein the device controller is adapted to implement the third operation mode when the sensed relative humidity is below a humidity threshold and to reduce the electric potential applied between the adjacent electrode plates until the measured electric current flowing through the electrode plates reduces to the current threshold, and wherein the flow controller is adapted to implement a flow rate reduction until the desired filtration efficiency reaches an efficiency threshold.

5. The electrostatic air cleaning device as claimed in claim 3, wherein the efficiency threshold comprises a fractional filtration efficiency for a particular particle size.

6. The electrostatic air cleaning device as claimed in claim 5, wherein the particular particle size is 200 nm particle diameter and the efficiency threshold is 0.9.

7. The electrostatic air cleaning device as claimed in claim 1, wherein the flow controller is a fan.

8. An electrostatic air cleaning method, comprising:

charging airborne particles in an air flow using a charging section;

filtering the air flow using a particle precipitation section which comprises parallel electrode plates having a voltage between adjacent electrode plates;

measuring an electric current flowing through the electrode plates;

sensing a relative humidity; and controlling the voltage between the adjacent electrode plates and controlling the air flow in dependence on the measured electric current flowing through the electrode plates, wherein a device controller, comprised in an electrostatic air cleaning device, implements:

a first, normal, operation mode when the measured electric current flowing through the electrode plates is below a current threshold;

a second operation mode when the measured electric current flowing through the electrode plates is above the current threshold, and a source of electric potential is controlled to reduce the electric current, wherein a flow controller, comprised in the electrostatic air cleaning device, is controlled to achieve a desired filtration efficiency, and wherein the measured electric current being above the current threshold is caused by a high relative humidity; and a third operation mode when the measured electric current flowing through the electrode plates is above the current threshold and the source of electric potential is controlled to reduce the electric current, wherein the flow controller is controlled to achieve the desired filtration efficiency, wherein the measured electric current being above the current threshold is caused by a level of particle deposition in the particle precipitation section, and wherein, in the third operation mode, the device controller provides output information as an output signal indicating that cleaning or replacement of the particle precipitation section is required.

9. The electrostatic air cleaning method as claimed in claim 8, comprising implementing the first operation mode by applying a maximum electric potential between the adjacent electrode plates, and implementing a flow rate as selected by a user of the electrostatic air cleaning device.

10. The electrostatic air cleaning method as claimed in claim 8, comprising implementing the second operation mode when the sensed relative humidity exceeds a humidity threshold and by reducing the electric potential between the adjacent electrode plates until the measured electric current flowing through the electrode plates reduces to the current threshold, and implementing a flow rate reduction until the desired filtration efficiency reaches an efficiency threshold.

11. The electrostatic air cleaning method as claimed in claim 8, comprising implementing the third operation mode when the sensed relative humidity is below a humidity threshold and by reducing the electric potential applied between the adjacent electrode plates until the measured electric current flowing through the electrode plates reduces to the current threshold, and implementing a flow rate reduction until the desired filtration efficiency reaches an efficiency threshold.

12. The electrostatic air cleaning method as claimed in claim 10, wherein the efficiency threshold comprises a fractional filtration efficiency for a particular particle size, for example, 200 nm particle diameter, and wherein the efficiency threshold is 0.9.

13. A non-transitory computer readable recording medium storing a computer program comprising computer program code means which is adapted, when said computer program is run on a computer, to implement the electrostatic air cleaning method of claim 8.

* * * * *